US012677904B2

(12) United States Patent
Jiang et al.

(10) Patent No.: US 12,677,904 B2
(45) Date of Patent: Jul. 14, 2026

(54) MAGNETIC SHOE

(71) Applicant: Haoyu Jiang, Taizhou (CN)

(72) Inventors: Xiangen Jiang, Taizhou (CN); Haoyu Jiang, Taizhou (CN)

(73) Assignee: Haoyu Jiang, Taizhou (CN)

( * ) Notice: Subject to any disclaimer, the term of this patent is extended or adjusted under 35 U.S.C. 154(b) by 0 days.

(21) Appl. No.: 18/923,069

(22) Filed: Oct. 22, 2024

(65) Prior Publication Data

US 2026/0076443 A1 Mar. 19, 2026

(30) Foreign Application Priority Data

Sep. 19, 2024 (CN) ..... 202411319385.8

(51) Int. Cl.

| | |
|---|---|
| ***A43B 1/00*** | (2006.01) |
| ***A43B 7/32*** | (2006.01) |
| ***A43B 13/12*** | (2006.01) |
| ***A43B 13/18*** | (2006.01) |
| ***A43B 13/22*** | (2006.01) |
| ***A43C 1/02*** | (2006.01) |

(52) U.S. Cl.

CPC ..... *A43B 7/32* (2013.01); *A43B 1/0054* (2013.01); *A43B 13/125* (2013.01); *A43B 13/181* (2013.01); *A43B 13/22* (2013.01); *A43C 1/02* (2013.01)

(58) Field of Classification Search

CPC ..... A43B 1/0054; A43B 7/088; A43B 7/24; A43B 13/125; A43B 13/181; A43C 1/02

See application file for complete search history.

(56) References Cited

U.S. PATENT DOCUMENTS

| | | | | |
|---|---|---|---|---|
| 5,553,398 | A * | 9/1996 | Schnewlin-Maier | A43B 17/04 36/43 |
| 7,694,440 | B1 * | 4/2010 | Wu | A43B 1/0054 36/28 |
| 9,370,221 | B1 * | 6/2016 | Hsu | A43B 1/0054 |
| 2003/0213146 | A1 * | 11/2003 | Tien | A43B 13/186 36/28 |
| 2004/0107602 | A1 * | 6/2004 | Brown | A43B 1/0018 36/28 |

(Continued)

FOREIGN PATENT DOCUMENTS

| | | | | |
|---|---|---|---|---|
| EP | 1435207 | A1 * | 7/2004 | A43B 17/06 |
| KR | 2001077535 | A * | 8/2001 | A43B 1/0054 |

(Continued)

*Primary Examiner* — Sharon M Prange

(57) ABSTRACT

Provided in the present disclosure is a magnetic shoe. The magnetic shoe includes an upper structure, a sole structure, and magnetic shock-absorbing structures, each of the magnetic shock-absorbing structures includes a first magnetic element and second magnetic elements, and the first magnetic elements and the second magnetic elements are all disposed in the sole structure; and a magnetic coupling direction of each of the first magnetic elements is a vertical direction, a magnetic coupling direction of each of the second magnetic elements is a first direction, and an acute angle is formed by the first direction and the vertical direction. By providing the magnetic shock-absorbing structures, the foot slides relative to the sole structure or the ankle is sprained can be avoided.

2 Claims, 5 Drawing Sheets

(56) References Cited

U.S. PATENT DOCUMENTS

| | | | | |
|---|---|---|---|---|
| 2008/0127518 | A1* | 6/2008 | Byrne | A43B 7/145 36/97 |
| 2008/0148599 | A1* | 6/2008 | Collins | A43B 17/02 36/43 |
| 2008/0263905 | A1* | 10/2008 | Tai | B29D 35/142 36/25 R |
| 2010/0011616 | A1* | 1/2010 | Chang | A43B 13/187 36/35 R |
| 2012/0102785 | A1* | 5/2012 | Rodman | A43B 1/0054 36/43 |
| 2016/0015124 | A1* | 1/2016 | Grell | A43B 13/10 36/102 |
| 2017/0049180 | A1* | 2/2017 | Lee | A43B 3/38 |
| 2017/0280824 | A1* | 10/2017 | Brown | A43B 7/1445 |
| 2017/0354203 | A1* | 12/2017 | Tavares | A43C 1/02 |
| 2018/0070673 | A1* | 3/2018 | Li | A43B 21/30 |
| 2020/0008513 | A1* | 1/2020 | Yao | A43B 13/187 |

FOREIGN PATENT DOCUMENTS

| | | | | |
|---|---|---|---|---|
| KR | 20060113126 A | * | 11/2006 | A43B 7/32 |
| KR | 20120003282 U | * | 5/2012 | A43B 7/32 |

* cited by examiner

MAGNETIC SHOE

CROSS-REFERENCE TO RELATED APPLICATIONS

The application claims priority of Chinese patent application CN2024113193858, filed on Sep. 19, 2024, which is incorporated herein by reference in its entireties.

TECHNICAL FIELD

The present disclosure relates to the technical field of footwear, in particular to a magnetic shoe.

BACKGROUND

Footwear generally includes two portions: an upper structure and a sole structure. The upper structure is fixed to the sole structure and encloses a cavity for receiving a foot of a wearer, and the sole structure is fixed to a lower surface of the upper structure so as to be positioned between the upper structure and a bottom surface structure.

The sole structure is generally provided with one or more buffering elements, and the buffering elements are configured to weaken or dissipate the force on the foot of the wearer that may be caused by the ground impact during walking or running. Particularly, the buffering elements are necessary to middle-aged and elderly people and large-weight wearers. The buffering elements may be springs, air cavities and magnetic shock absorbers.

The existing buffering elements achieve the shock-absorbing and buffering effects through the deformation in a vertical direction or the change of cavity volumes. However, the force on the wearer during walking or running is not only in the vertical direction, and the buffering elements have the poor effect on the impact that is not in the vertical direction, particularly for the large-weight wearer.

SUMMARY

On this basis, it is necessary to provide a magnetic shoe to solve the at least one problem.

The present disclosure provides a magnetic shoe, comprising:

an upper structure;

a sole structure, which is connected to the upper structure and encloses an accommodating cavity for accommodating a foot, where the accommodating cavity is provided with an opening allowing the foot to enter; and magnetic shock-absorbing structures, each of which comprises a first magnetic element and second magnetic elements, where the first magnetic elements and the second magnetic elements are all disposed in the sole structure; and a magnetic coupling direction of each of the first magnetic elements is a vertical direction, a magnetic coupling direction of each of the second magnetic elements is a first direction, and an acute angle is formed by the first direction and the vertical direction.

Further, each of the magnetic elements comprises a first magnetic coupler and a second magnetic coupler, one of the first magnetic coupler and the second magnetic coupler comprises a magnet, and the other comprises at least one of a magnet and a magnetic material.

Further, the sole structure comprises a central region and an edge region surrounding the central region, and an upper surface of the edge region is inclined relative to an upper surface of the central region; and the second magnetic elements are adjacent to the first magnetic elements, the first magnetic elements are located in the central region, and at least part of the second magnetic elements are located in the edge region.

Further, each of the magnetic shock-absorbing structures comprises one first magnetic element and two second magnetic elements, and the two second magnetic elements are respectively located on two opposite sides of the first magnetic element.

Further, the sole structure comprises a front shoe region, a middle shoe region and a shoe heel region which are arranged in sequence, and both the front shoe region and the shoe heel region are provided with the magnetic shock-absorbing structures.

Further, the sole structure further comprises a shock-absorbing pad, and the shock-absorbing pad is located at the tops of the magnetic shock-absorbing structures; and the shock-absorbing pad comprises a central region and an edge region surrounding the central region, an upper surface of the edge region is inclined relative to an upper surface of the central region, and both the central region and the edge region are provided with protrusions.

Further, the sole structure further comprises a shock-absorbing layer, and the shock-absorbing layer is located inside the sole structure.

Further, the magnetic shoe further comprises a shoelace, where the shoelace is a tying-free shoelace.

Further, the tying-free shoelace is an elastically deformable annular shoelace, the upper structure is provided with shoelace holes, and the annular shoelace passes through the shoelace holes.

Further, the magnetic shoe further comprises an insole, where the insole is filled with particles.

Further, a side surface of the insole is provided with a sweat releasing structure, and the sweat releasing structure comprises a plurality of V-shaped grooves arranged in sequence.

Further, the sole structure is further provided with non-slip lines, and the non-slip lines are located on one side of the sole structure away from the upper structure.

It can be seen from the above technical solutions that the embodiments of the present disclosure at least have the following advantages and positive effects:

according to the magnetic shoe, by providing the first magnetic elements with the magnetic coupling directions being the vertical direction and the second magnetic elements with the magnetic coupling directions forming the acute angles with the vertical direction, the buffering and shock-absorbing effect in the vertical direction can be provided, buffering can also be provided for transverse shifting, an ankle can be protected, and the situation that the foot slides relative to the sole structure 200 or the ankle is sprained can be avoided.

BRIEF DESCRIPTION OF THE DRAWINGS

In order to explain embodiments of the present disclosure or technical solutions in the prior art more clearly, drawings needed in descriptions of the embodiments or the prior art will be briefly introduced below. Obviously, the accompanying drawings in the following descriptions are only some embodiments of the present disclosure, and for a person of ordinary skill in the art, other drawings can be obtained according to structures shown in these accompanying drawings without involving any inventive effort. In the drawings.

DESCRIPTIONS OF THE REFERENCE SIGNS

Figure 1:
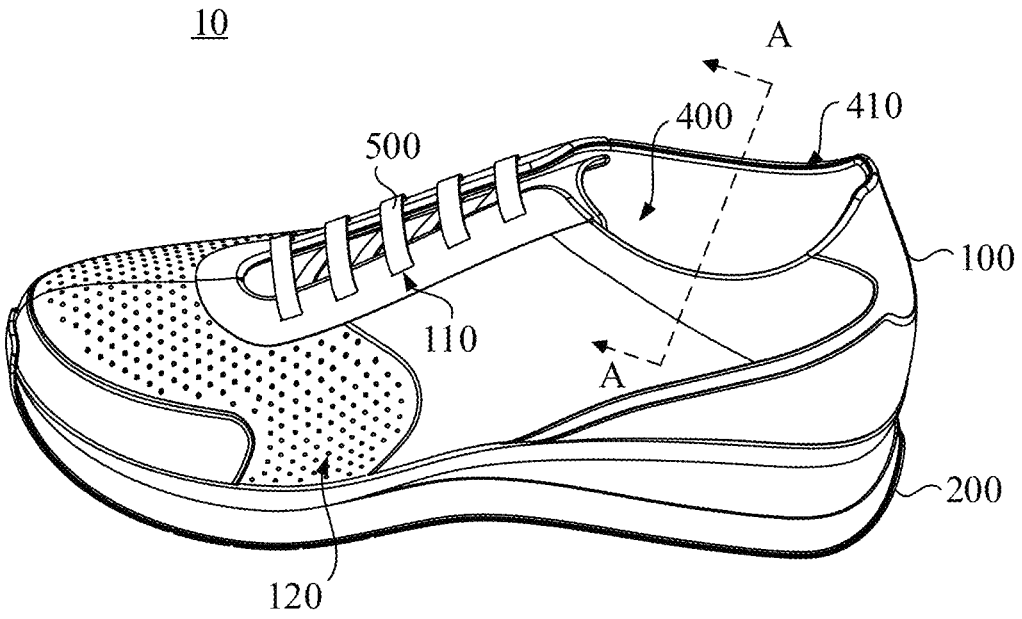
FIG. 1 is an overall structural schematic diagram of a magnetic shoe in an embodiment of the present disclosure.

10. magnetic shoe;

100. upper structure; 110. shoelace hole; 120. air hole;

200. sole structure; 201. front shoe region; 202. middle shoe region; 203. shoe heel region; 210. central region; 220. edge region; 230. shock-absorbing pad; 231. protrusion; 240. shock-absorbing layer;

300. magnetic shock-absorbing structure; 310. first magnetic element; 311. first magnetic coupler; 312. second magnetic coupler; 320. second magnetic element;

400. accommodating cavity; 410. opening;

500. shoelace;

600. insole; 610. particle; 620. sweat releasing structure; 621. V-shaped groove; and

700. non-slip line.

DETAILED DESCRIPTION OF EMBODIMENTS

Typical embodiments that show the characteristics and advantages of the present disclosure will be described in detail in the following description. It should be understood that the present disclosure can have various changes in different embodiments, which do not depart from the scope of the present disclosure. In addition, the description and drawings herein are essentially for the purpose of describing, instead of limiting the present disclosure.

Besides, the terms "first" and "second" are only for the purpose of describing, and cannot be understood as indicating or implying the relative importance or implicitly indicating the number of technical features indicated. Thus, the features defined as "first" and "second" may explicitly or implicitly include one or more such features. In the description of the present disclosure, unless otherwise explicitly specified, "a plurality of" means two or more. In addition, "/" indicates the meaning of "or", for example, A/B may indicate A or B; and the term "and/or" herein is only intended to describe association relationships of associated objects, and indicates that there may be three relationships, for example, the expression of "A and/or B" may indicate the following three conditions: A exists separately, A and B exist at the same time, and B exists separately.

Unless otherwise explicitly specified and limited, the terms "arranging", "connecting" and "connection" should be understood in a broad sense, for example, they may be fixed connection, and may also be detachable connection or integrated connection; they may be mechanical connection, and may also be electrical connection; and they may be direct connection, may also be indirect connection by means of intermediate media, and may also be communication of the insides of two elements. For those of ordinary skill in the art, specific meanings of the above terms in the present disclosure can be understood according to specific circumstances.

In an existing shoe with a buffering function, buffering elements achieve the shock-absorbing and buffering effects through the deformation in a vertical direction or the change of cavity volumes. However, the force on a wearer during walking or running is not only in the vertical direction, and the buffering elements have the poor effect on the impact that is not in the vertical direction, particularly for the large-weight wearer.

In order to solve the above at least one problem, the present disclosure provides a magnetic shoe 10.

Figure 2:
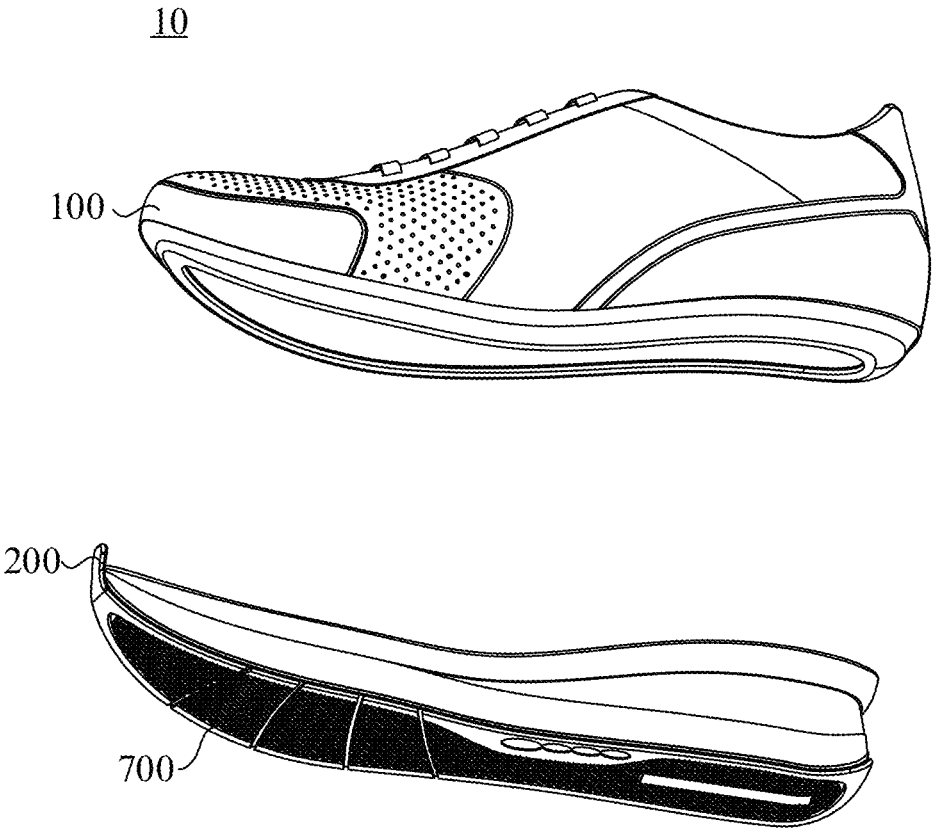
FIG. 2 shows an exploded view of the magnetic shoe as shown in FIG. 1 at another viewing angle.
Figure 3:
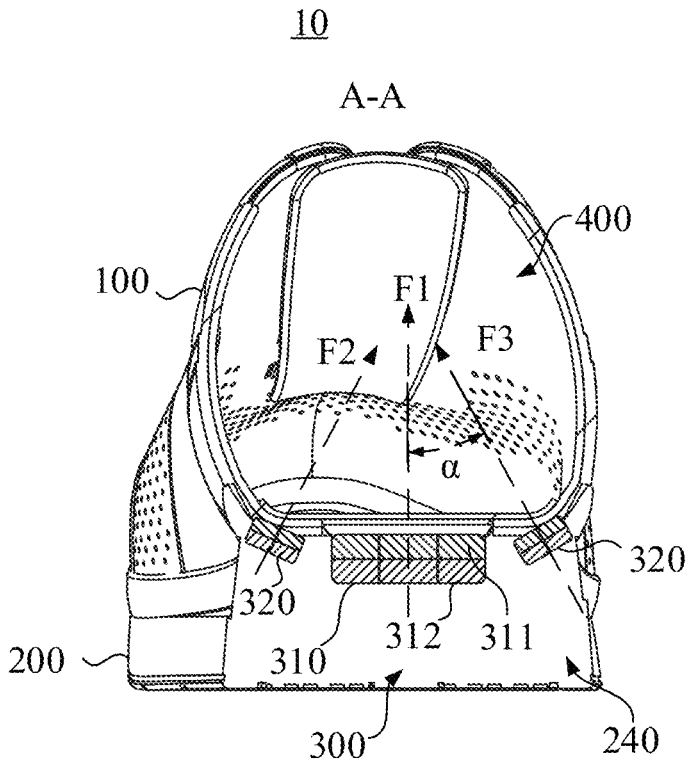
FIG. 3 shows a sectional view of the magnetic shoe as shown in FIG. 1 along a section line A-A.

Reference is made to FIG. 1, FIG. 2 and FIG. 3. The magnetic shoe 10 includes an upper structure 100, a sole structure 200, and magnetic shock-absorbing structures 300, where the sole structure 200 is connected to the upper structure 100 and encloses an accommodating cavity 400 for accommodating a foot, and the accommodating cavity 400 is provided with an opening 410 allowing the foot to enter. The foot of a wearer can enter the accommodating cavity 400 via the opening 410, so that the foot is wrapped in the magnetic shoe 10, and the magnetic shoe 10 plays a role in protecting the foot and reducing the impact.

In this embodiment, reference is made to FIG. 1, the magnetic shoe 10 further includes a shoelace 500, where the shoelace 500 is a tying-free shoelace 500, and the tying-free shoelace 500 is the shoelace 500 which is not required to be tightened or loosened by hand, so that the free and convenient putting-on and taking-off manner is provided, stable support and comfortable foot wrapping are provided, and the problems of tangling and loosening of the shoelace 500 can be reduced.

Specifically, the tying-free shoelace 500 is an elastically deformable annular shoelace 500, the upper structure 100 is provided with shoelace holes 110, and the annular shoelace 500 passes through the shoelace holes 110. Thus, the magnetic shoe 10 can be put on through elastic deformation of the annular shoelace 500, meanwhile, the elastically deformable annular shoelace 500 can bring about the stable support and comfortable foot wrapping. It can be understood that in other embodiments, the tying-free shoelace 500 may also be another connection manner, including but is not limited to a magnetic buckle and a Velcro® hook and loop fastener.

In this embodiment, reference is continuously made to FIG. 1, the upper structure 100 is further provided with air holes 120, where the air holes 120 can enhance the air permeability of the upper structure 100, thereby achieving the effects of exhausting air, achieving deodorization and increasing the comfort feeling of the wearer. A manufacturer can freely set the region having the air holes 120 according to requirements, and the region can be any portion of the upper structure 100. Besides, in other embodiments, the upper structure 100 may not be provided with the air holes 120.

FIG. 3 shows that each of the magnetic shock-absorbing structures 300 includes a first magnetic element 310 and second magnetic elements 320, where the first magnetic elements 310 and the second magnetic elements 320 are all disposed in the sole structure 200. A magnetic coupling direction of each of the first magnetic elements 310 is a vertical direction, the second magnetic elements 320 have magnetic coupling directions in a first direction F2 and a second direction F3, and an acute angle is formed by the first direction F2 and the vertical direction. The magnetic coupling direction of each of the first magnetic elements 310 is as shown by F1 in FIG. 3, and the first direction F2 and the second direction F3 are as shown in FIG. 3.

In the magnetic shoe 10 in the present disclosure, by providing the first magnetic elements 310 with the magnetic coupling directions being the vertical direction and the second magnetic elements 320 with the magnetic coupling directions forming the acute angles with the vertical direction, the buffering and shock-absorbing effect in the vertical direction can be provided, buffering can also be provided for transverse shifting, an ankle can be protected, and the situation that the foot slides relative to the sole structure 200 or the ankle is sprained can be avoided.

Specifically, an included angle formed by the magnetic coupling direction of each of the first magnetic elements 310 and the magnetic coupling direction of each of the second magnetic elements 320 is $\alpha$, where $30° \leq \alpha \leq 45°$. When the included angle $\alpha$ is less than 30°, the magnetic coupling direction of each of the second magnetic elements 320 is close to the vertical direction, so that the shock-absorbing effect for preventing sliding of the foot or spraining of the ankle is insufficient; and when the included angle $\alpha$ is greater than 45°, the discomfort is caused to the foot by the excessively large shock-absorbing action force on the foot in the magnetic coupling direction of the second magnetic element 320, and the wearing experience feeling is poor.

In this embodiment, reference is continuously made to FIG. 3, each of the magnetic elements includes a first magnetic coupler 311 and a second magnetic coupler 312, one of the first magnetic coupler 311 and the second magnetic coupler 312 includes a magnet, and the other includes at least one of a magnet and a magnetic material. That is, a magnetic coupling force can not only be generated between the magnet and the magnet, but also be generated between the magnet and the magnetic material, and the magnetic material includes but is not limited to an iron sheet, a cobalt sheet, and a nickel sheet.

Figure 4:
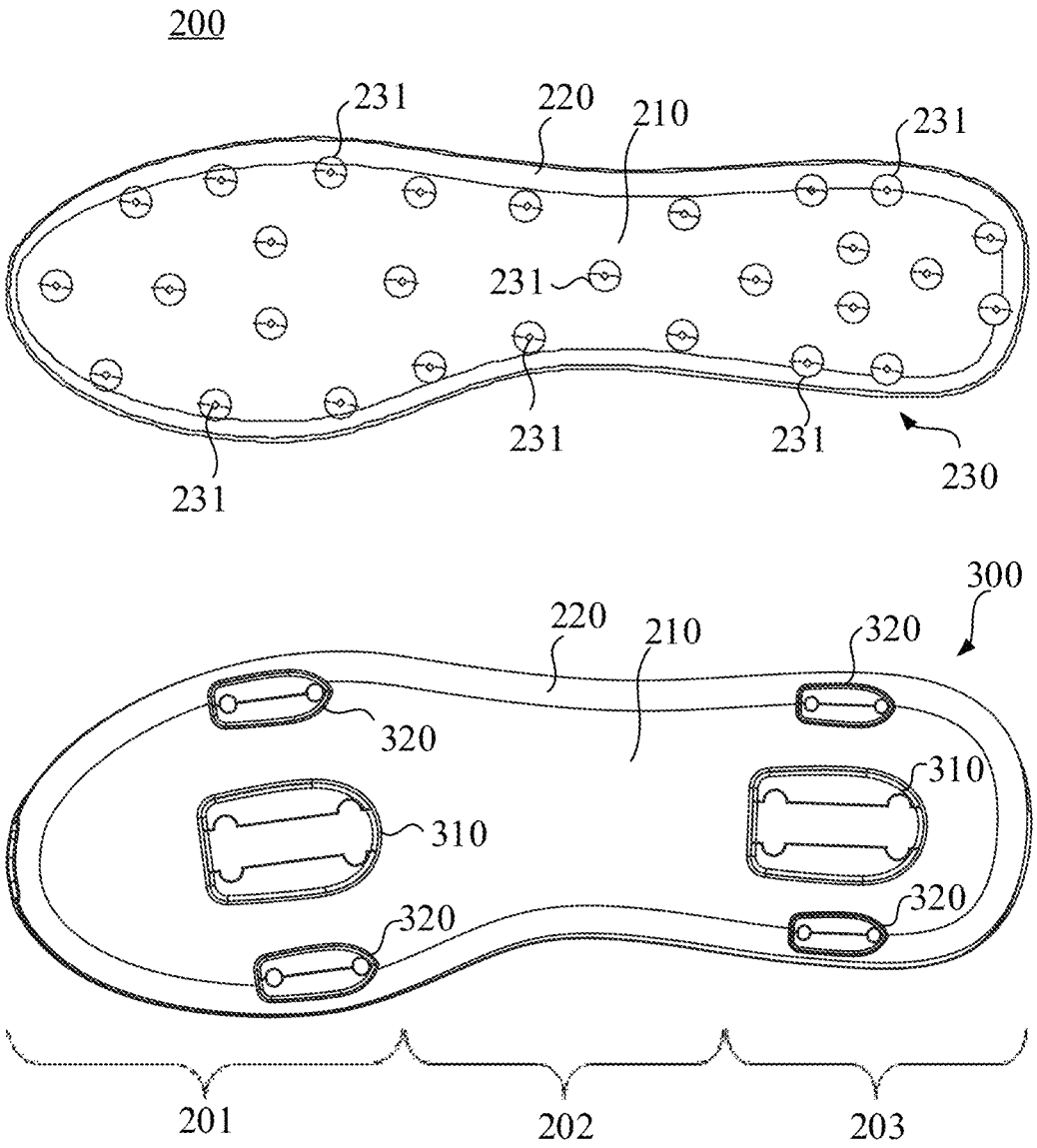
FIG. 4 shows an exploded view of a sole structure of the magnetic shoe as shown in FIG. 2.

Specifically, reference is made to FIG. 3 and FIG. 4 together, the sole structure 200 includes a central region 210 and an edge region 220 surrounding the central region 210, and an upper surface of the edge region 220 is inclined relative to an upper surface of the central region 210; and the second magnetic elements 320 are adjacent to the first magnetic elements 310, the first magnetic elements 310 are located in the central region 210, and at least part of the second magnetic elements 320 are located in the edge region 220. Thus, the magnetic coupling directions F1 of the first magnetic elements 310 are perpendicular to or approximately perpendicular to the adjacent upper surface of the sole structure 200, and the magnetic coupling directions of the second magnetic elements 320 are perpendicular to or approximately perpendicular to the adjacent upper surface of the sole structure 200, thereby improving the shock-absorbing efficiency of the magnetic elements.

Further, reference is made to FIG. 3 and FIG. 4, each of the magnetic shock-absorbing structures 300 includes one first magnetic element 310 and two second magnetic elements 320, and the two second magnetic elements 320 are respectively located on two opposite sides of the first magnetic element 310. Thus, the first magnetic element 310 directly faces the central region 210 of the heel of the wearer, the two second magnetic elements 320 respectively correspond to left and right sides of the heel of the wearer, and the directions of the magnetic coupling action forces are as shown in FIG. 3. It can be understood that if the second magnetic element 320 is only disposed on one side of the first magnetic element 310, the second magnetic element 320 will cause single-side stress on the heel of the wearer while generating buffering for the heel of the wearer, so that the overall stress of the heel is unbalanced, which may affect the comfort of the wearer. Thus, by providing the second magnetic elements 320 on the two opposite sides of the first magnetic element 310 at the same time, the discomfort of the wearer caused by the single-side stress is avoided or reduced.

In this embodiment, reference is made to FIG. 3, the two second magnetic elements 320 are provided on the two opposite sides of the first magnetic element 310, and the magnetic coupling directions F2 and F3 of the two second magnetic elements 320 are symmetric about the magnetic coupling direction F1 of the first magnetic element 310, so that the stress on two sides of the heel of the wearer is uniform, and meanwhile, the all-round and full-wrapping shock-absorbing effect can be achieved.

Specifically, reference is made to FIG. 4, the sole structure 200 includes a front shoe region 201, a middle shoe region 202 and a shoe heel region 203 which are arranged in sequence, and both the front shoe region 201 and the shoe heel region 203 are provided with the magnetic shock-absorbing structures 300. Thus, the good shock-absorbing and buffering effect can be provided for the heel and joints of phalanxes and metatarsal bones of the wearer, meanwhile, the stress on the foot of the wearer is more uniform, and the comfort is higher. It can be understood that the manufacturer can adjust the number and distribution positions of the magnetic shock-absorbing structures 300 according to requirements, for example, the magnetic shock-absorbing structures 300 can be disposed in the middle shoe region 202, which is not limited in the present application.

In this embodiment, reference is continuously made to FIG. 4, the sole structure 200 further includes a shock-absorbing pad 230, the shock-absorbing pad 230 is located at the tops of the magnetic shock-absorbing structures 300, the shock-absorbing pad 230 is adapted to the magnetic shock-absorbing structures 300, and the shock-absorbing pad 230 is in contact with the foot of the wearer or is in indirect contact with the foot of the wearer by means of an insole 600. Correspondingly, the shock-absorbing pad 230 includes a central region 210 and an edge region 220 surrounding the central region 210, an upper surface of the edge region 220 is inclined relative to an upper surface of the central region 210, and both the central region 210 and the edge region 220 are provided with protrusions 231. Thus, the protrusions 231 can be matched with the corresponding magnetic elements to achieve the best buffering and shock-absorbing effect, and the protrusions 231 also have the effect of foot bottom massage, so that the more comfortable wearing experience can be brought to the wearer.

Figure 5:
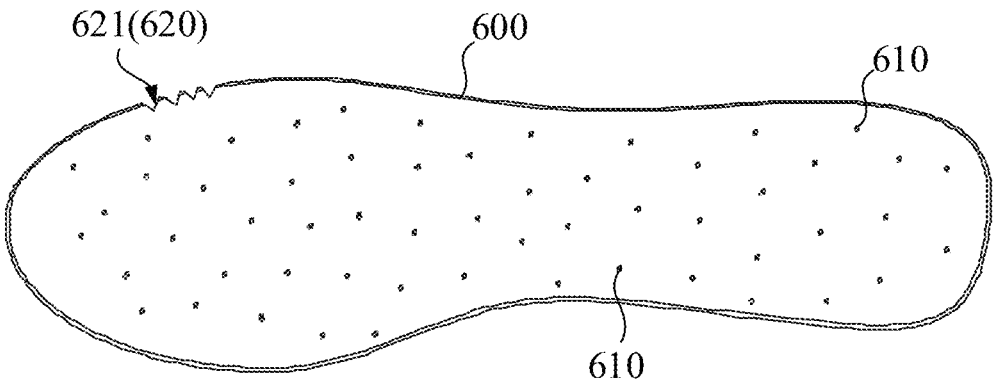
FIG. 5 shows an overall structural schematic diagram of an insole of the magnetic shoe as shown in FIG. 1.

In this embodiment, reference is made to FIG. 5, the magnetic shoe 10 further includes the insole 600, where the insole 600 is filled with loose particles 610; the particles 610 may include one or more polymer foam materials, such as ethylene vinyl acetate or polyurethane, and the particles 610 may also include foam beads; and the different particles 610 are freely distributed, and the volumes and densities may be the same or different. The particles 610 are elastic, and small cavities may be formed when the insole 600 is filled with the particles, so that the insole 600 has shock-absorbing and deodorizing functions.

Specifically, a side surface of the insole 600 is provided with a sweat releasing structure 620, and the sweat releasing structure 620 includes a plurality of V-shaped grooves 621 arranged in sequence, so as to achieve the better sweat releasing and deodorizing effects. It should be noted that in other embodiments, the V-shaped grooves 621 can be replaced with U-shaped grooves and square grooves. In addition, a plurality of sweat releasing structures 620 are provided, and the plurality of sweat releasing structures 620 are arranged on the side surface of the insole 600 at intervals, which is not limited in the present application.

Specifically, reference is made to FIG. 2, the sole structure 200 is further provided with non-slip lines 700, and the non-slip lines 700 are located on one side of the sole structure 200 away from the upper structure 100. In this embodiment, a plurality of non-slip lines 700 are provided, and the plurality of latticed non-slip lines 700 are formed in a lower surface of the sole structure 200 at intervals. Of course, the manufacturer can adjust the shape, number and distribution positions of the non-slip lines 700 according to requirements, which are not limited in the present application.

Reference is made to FIG. 3, in this embodiment, the sole structure 200 is further provided with a shock-absorbing layer 240, and the shock-absorbing layer 240 is disposed inside the sole structure 200. The shock-absorbing layer 240 is composed of an elastic material with the high deformation recovery ability, and can provide certain rebound resilience for the sole structure 200 so as to improve the buffering effect, and the elastic material may be natural rubber, synthetic rubber, foamed TPU (thermoplastic polyurethane elastomer). Of course, the shock-absorbing layer 240 may also be an air bag cavity, and the resilience is achieved through the change of the volume of the air bag cavity.

The specific embodiments described herein are only examples of the spirit of the present application. A person skilled in the art of the present application can make various amendments or supplements to the described specific embodiments or replace same with similar manners, which do not depart from the scope defined by the spirit of the present application.

What is claimed is:

1. A magnetic shoe, comprising:

an upper structure;

a sole structure, which is connected to the upper structure and encloses an accommodating cavity for accommodating a foot, wherein the accommodating cavity is provided with an opening allowing the foot to enter; and magnetic shock-absorbing structures, each of which comprises a first magnetic element and second magnetic elements, wherein the first magnetic elements and the second magnetic elements are all disposed in the sole structure; the first magnetic element and the second magnetic elements of each magnetic shock-absorbing structure are substantially arranged along a width direction of the magnetic shoe; and each of the first magnetic element and the second magnetic element comprises a first magnetic coupler and a second magnetic coupler; a magnetic coupling direction of each of the first magnetic elements is a vertical direction, the second magnetic elements have magnetic coupling directions in a first direction and a second direction, and an acute angle is formed by the first direction and the vertical direction;

wherein each of the magnetic shock-absorbing structures comprises one first magnetic element and two second magnetic elements, and the two second magnetic elements are respectively located on two opposite sides of the first magnetic element;

wherein the sole structure comprises a front shoe region, a middle shoe region and a shoe heel region which are arranged in sequence, and both the front shoe region and the shoe heel region are provided with the magnetic shock-absorbing structures.

2. A magnetic shoe, comprising:

an upper structure;

a sole structure, which is connected to the upper structure and encloses an accommodating cavity for accommodating a foot, wherein the accommodating cavity is provided with an opening allowing the foot to enter; and magnetic shock-absorbing structures, each of which comprises a first magnetic element and second magnetic elements, wherein the first magnetic elements and the second magnetic elements are all disposed in the sole structure; the first magnetic element and the second magnetic elements of each magnetic shock-absorbing structure are substantially arranged along a width direction of the magnetic shoe; and each of the first magnetic element and the second magnetic element comprises a first magnetic coupler and a second magnetic coupler; a magnetic coupling direction of each of the first magnetic elements is a vertical direction, the second magnetic elements have magnetic coupling directions in a first direction and a second direction, and an acute angle is formed by the first direction and the vertical direction;

wherein the first direction and the second direction are symmetric about the vertical direction.

* * * * *